US007178788B1

(12) United States Patent
Flud et al.

(10) Patent No.: US 7,178,788 B1
(45) Date of Patent: Feb. 20, 2007

(54) EVEN REEVING SYSTEM FOR A TOP DRIVE EARTH DRILLING MACHINE

(75) Inventors: Sammy Kent Flud, Brownwood, TX (US); Thomas Nelson McKnight, Austin, TX (US)

(73) Assignee: Eagle Rock Manufacturing, LLC, Midland, TX (US)

( * ) Notice: Subject to any disclaimer, the term of this patent is extended or adjusted under 35 U.S.C. 154(b) by 306 days.

(21) Appl. No.: 10/982,364

(22) Filed: Nov. 5, 2004

(51) Int. Cl.
*B66D 1/36* (2006.01)

(52) U.S. Cl. ..... 254/337

(58) Field of Classification Search ..... 254/337, 254/338, 375, 380; 175/203, 207; 166/75.11
See application file for complete search history.

(56) References Cited

U.S. PATENT DOCUMENTS 3,747,402 A * 7/1973 Branham et al. ..... 73/152.01
3,917,230 A * 11/1975 Barron ..... 254/270
4,407,629 A 10/1983 Willis ..... 414/745.2
4,787,244 A * 11/1988 Mikolajczyk ..... 73/152.01
4,796,863 A * 1/1989 Reed ..... 254/337
4,842,250 A 6/1989 Willis ..... 254/337
5,762,279 A * 6/1998 Horton, III ..... 254/285
2004/0069532 A1 4/2004 Keast ..... 175/57

FOREIGN PATENT DOCUMENTS

WO WO9214028 * 8/1992

* cited by examiner

*Primary Examiner*—Emmanuel M Marcelo
(74) *Attorney, Agent, or Firm*—Buskop Law Group PC; Wendy K. Buskop

(57) ABSTRACT

An earth drilling machine includes a mast, a crown block assembly mounted on the mast top for providing a drilling line having front sheaves, a fast line sheave mounted to a crown block sheave for reeving the drilling line, a drawworks drum, and a traveling frame assembly a midpoint of a width of a drawworks assembly aligned with the fast line sheave. The drawworks drum has a drum axis, the front sheaves are all aligned on a front axis, the fast line sheave and the deadline sheave are both aligned on a back axis, and the traveling sheaves are aligned on a traveling frame axis. The front axis, back axis, and traveling frame axis are parallel to the drum axis. The crown cross over sheave defines a cross over axis and the cross over axis is mounted perpendicular to the drum axis.

20 Claims, 5 Drawing Sheets

EVEN REEVING SYSTEM FOR A TOP DRIVE EARTH DRILLING MACHINE

FIELD

The present embodiments relate generally to a drilling rig. Specifically, the present embodiments relate to even reeving systems for a top drive drilling system.

BACKGROUND

A typical top drive earth drilling machine consists of substructure with a mast and drawworks mounted thereon. The traditional purpose of a mast is to support hoisting loads during the drilling operation. In the case of a top drive earth drilling machine, the mast may also be required to guide a traveling top drive unit and withstand the torque applied to the mast from the rotating drill pipe. A crown assembly consisting of an array of sheaves is attached to the top of a mast for the purpose of connecting a drilling line from a drawworks mounted on a substructure to a traveling top drive assembly. The relative orientation of the drawworks, crown sheaves, and traveling top drive assembly are designed to permit reeving the drilling line.

U.S. Pat. No. 4,842,250 (Willis) teaches an earth drilling machine with a drawworks drum having axis of rotation perpendicular to the axis of rotation of all of the sheaves of the invention. The perpendicular orientation of the drum requires that the entire drawworks and drum must be angled to prevent wear on the drilling line. This is a very costly and time consuming operation because of the cost and labor associated with mounting the drawworks drum at an angle so that the drilling line does not create angle with the fast line sheave that would cause extensive wear.

U.S. Pat. No. 4,407,629 (Willis) teaches a drilling machine with a system of inserting drilling pipe into place, from a horizontal position using an extensive clamping system.

A need exists for an earth drilling machine that does not require the drawworks to be mounted at an angle, and the embodiments described in this application meet these needs.

A need exists for a earth drilling machine that does not require the sheaves to be at angles to each other in order to reduce friction on the drilling line.

A need exists for a drilling machine with a system of efficiently placing the drilling pipe in place to be used.

The current art requires a band breaking system that requires water to cool the system and prevent over heating and damage. A need exists for a rotary drilling rig that uses a simpler more efficient breaking system.

A need also exists for a more reliable drilling rig system, with less wear on the wire line and the wire line sheaves.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments and that it can be practiced or carried out in various ways.

The present embodiments relate to earth drilling machine that helps the environment by providing a drilling machine with a small footprint for reduced environmental impact to the land.

The embodied system includes a top drive earth moving machine, namely a drilling rig that moves with less than ½ the load required to transport a conventional drilling rig. This machine in a preferred embodiment has a lighter weight design compared to conventional designs. In the preferred embodiment, the earth moving machine is up to 50% less than the weight of a comparable drilling machine using a rotary table. The lightweight embodiments of the drilling machine require only half the number of transport trucks typically needed to move the rig from one location to another, thereby saving numerous gallon of expensive diesel fuel. In a preferred embodiment, this rig uses about 450 gallons per day of diesel, which is considerably less than comparable conventional drilling rigs with rotary tables.

The embodied drilling machine saves energy by providing an embodiment that utilizes a unique braking system that utilizes less fossil fuel and/or electricity to stop than conventional drilling systems. Additionally, the brakes do not require an external cooling system, thereby saving large amounts of energy that are typically required to conventional braking system.

The present embodiments save lives by requiring only a two man crew to rig up and operate the rig. Most conventional rigs require at least a four man crew to transport and set up and operate the rig. The present embodiments require only a driller and a helper. Conventional rigs typically require a driller, a helper, a tong operator, and a derrick man for racking pipe.

The present invention is more reliable with less wear on the wire line and the wire line sheaves, thereby eliminating the need for extra sheaves and eliminating the need for a drawworks drum at an angle due to utilizing the even reeving system.

Figure 1:
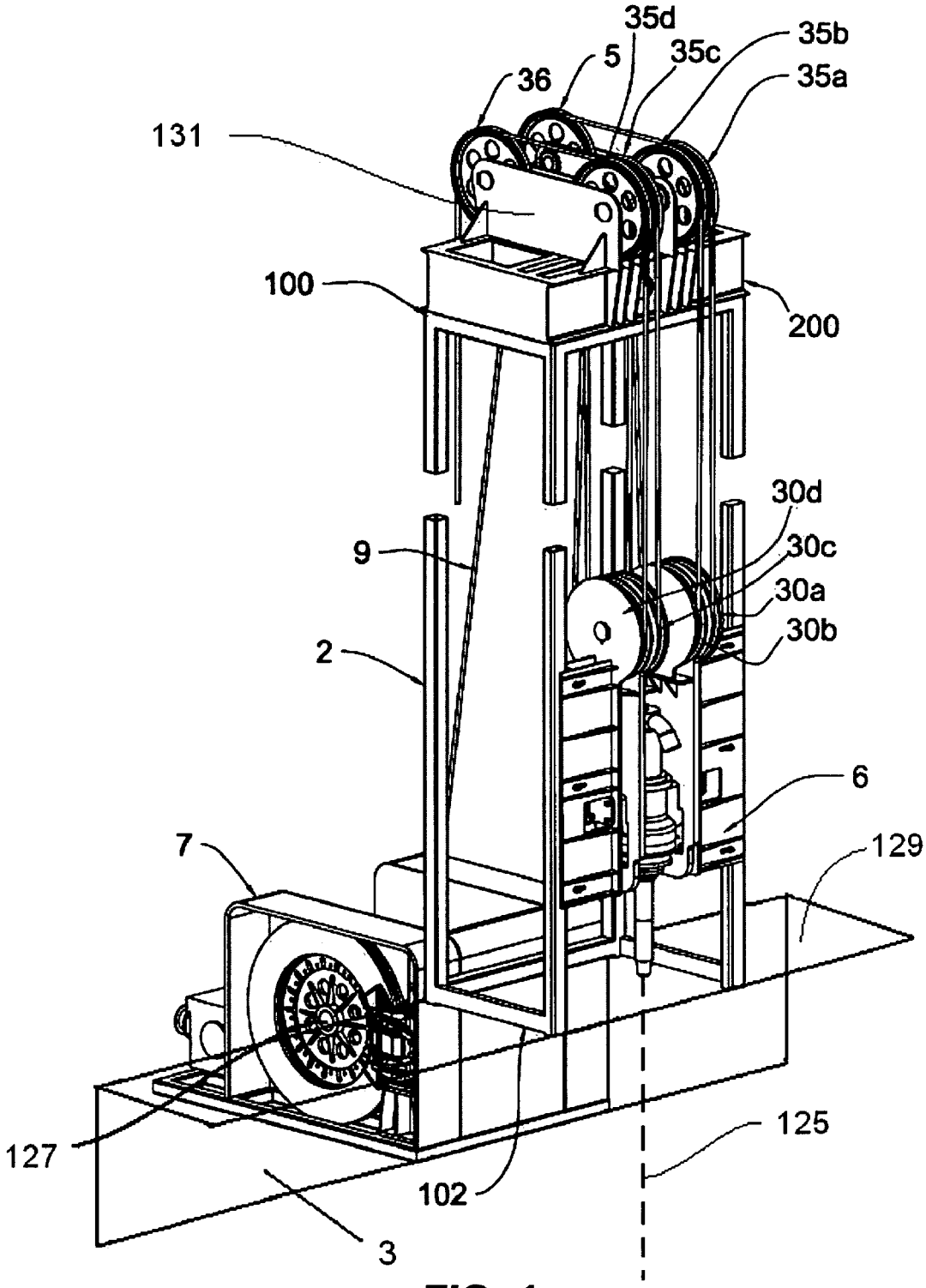
FIG. 1 depicts a perspective view of a machine for earth drilling.

With reference to the figures, FIG. 1 depicts a top drive earth drilling machine, namely, a top drive drilling rig for drilling oil wells, natural gas wells, water wells or other holes in the earth. The rig incorporates a lightweight transport feature that allows the use of the rig to be extended to on offshore platforms for offshore drilling. The drilling equipment can be used to drill holes in the earth for construction applications.

FIG. 1 depicts a mast (2) having a mast top (100) and mast bottom (102). The mast bottom is mounted to a substructure (3) connected to a drilling floor (129). In a preferred embodiment, the mast can be mounted to a drilling floor (129).

The substructure can be moveable, such as a truck, a trailer, a barge, or an offshore platform. Alternatively, the substructure can be stationary, such as a steel frame embedded in the earth. The only connection between the mast and the substructure is the drilling line.

The mast is a device that supports the hoisting mechanism. The mast can serve as a tracking mechanism for guiding a traveling swivel frame assembly. In one embodiment, the mast is a tubular mast. In another embodiment, the mast can be a derrick where the two front legs of the derrick support and/or guide the traveling swivel frame assembly. In supporting the traveling swivel frame assembly, the mast can provide a stabilizing force to support the torque applied to traveling swivel frame assembly by a top drive unit.

In another embodiment, the mast is designed to support at least 300,000 pound loads. In a most preferred embodiment, the mast can have a height ranging from 50 feet to 140 feet, preferably the mast is a 66-foot single piece mast. Other preferred heights are 96 feet and 112 feet. In a preferred embodiment, the mast is free standing without guide wires. The mast can be modular and can be assembled at a site. The masts can made from steel, aluminum or alloys thereof. The use of aluminum results in reduced weight of the drilling rig structure.

Additionally, a crown block assembly (200) is mounted on the mast top for receiving and conveying a drilling line (9). The drilling line can be a wire rope or steel cable with a diameter ranging from 1-inch to 1⅛ inches. An example of a drilling line is Flex-X-9™ available from Wire Rope Corporation of America of Missouri.

The sheaves are wheels or pulleys that allow cable, wire rope, or other type of flexible drilling line to run through. The drilling line (9) travels along any portion of the circumference of the sheave without coming off of the sheave. An example of a sheave is McKissick sheave available from Crosby Group of Tulsa, Okla. The sheaves are used to change the direction of the drilling line and can each rotate around an axis.

Continuing with FIG. 1, the crown block assembly has four front sheaves (35*a*, 35*b*, 35*c*, and 35*d*). The crown block assembly (200) has a frame (131) for attaching a fast line sheave, a dead line sheave, and the front sheaves to the crown block assembly (200). In other embodiments, fewer or more than four front sheaves can be used depending on the hoisting capacity of the top drive earth drilling machine. Alternatively, the four front sheaves can each be two pairs of sheaves.

A traveling swivel frame assembly (6) embodied in FIG. 1 has four traveling sheaves (30*a*, 30*b*, 30*c* and 30*d*) mounted to the mast (2). The traveling swivel frame assembly runs vertically along the vertical axis (125) that extends from the mast top (100) to the mast bottom (102).

The top drive earth machine includes a fast line sheave (5) mounted to the crown block assembly (200) for reeving the drilling line (9). The first front sheave (35*a*) transfers the drilling line (9) from the fast line sheave (5) to the first traveling sheave (30*a*). The first traveling sheave (30*a*) transfers the drilling line (9) to the second front sheave (35*b*). The second front sheave (35*b*) transfers the drilling line (9) to the second traveling sheave (30*b*). The second traveling sheave (30*b*) transfers the drilling line (9) to the cross over sheave (31) as shown in FIG. 2.

The cross over sheave (31) transfers the drilling line (9) to the third traveling sheave (30*c*) and the third traveling sheave transfers the drilling line (9) to the third front sheave (35*c*). The third front sheave (35*c*) transfers the line to the forth traveling sheave (30*d*) and the forth traveling sheave (30*d*) transfers the drilling line (9) to the forth front sheave (35*d*). The forth front sheave (35*d*) transfers the drilling line (9) to the dead line sheave (36).

Figure 2:
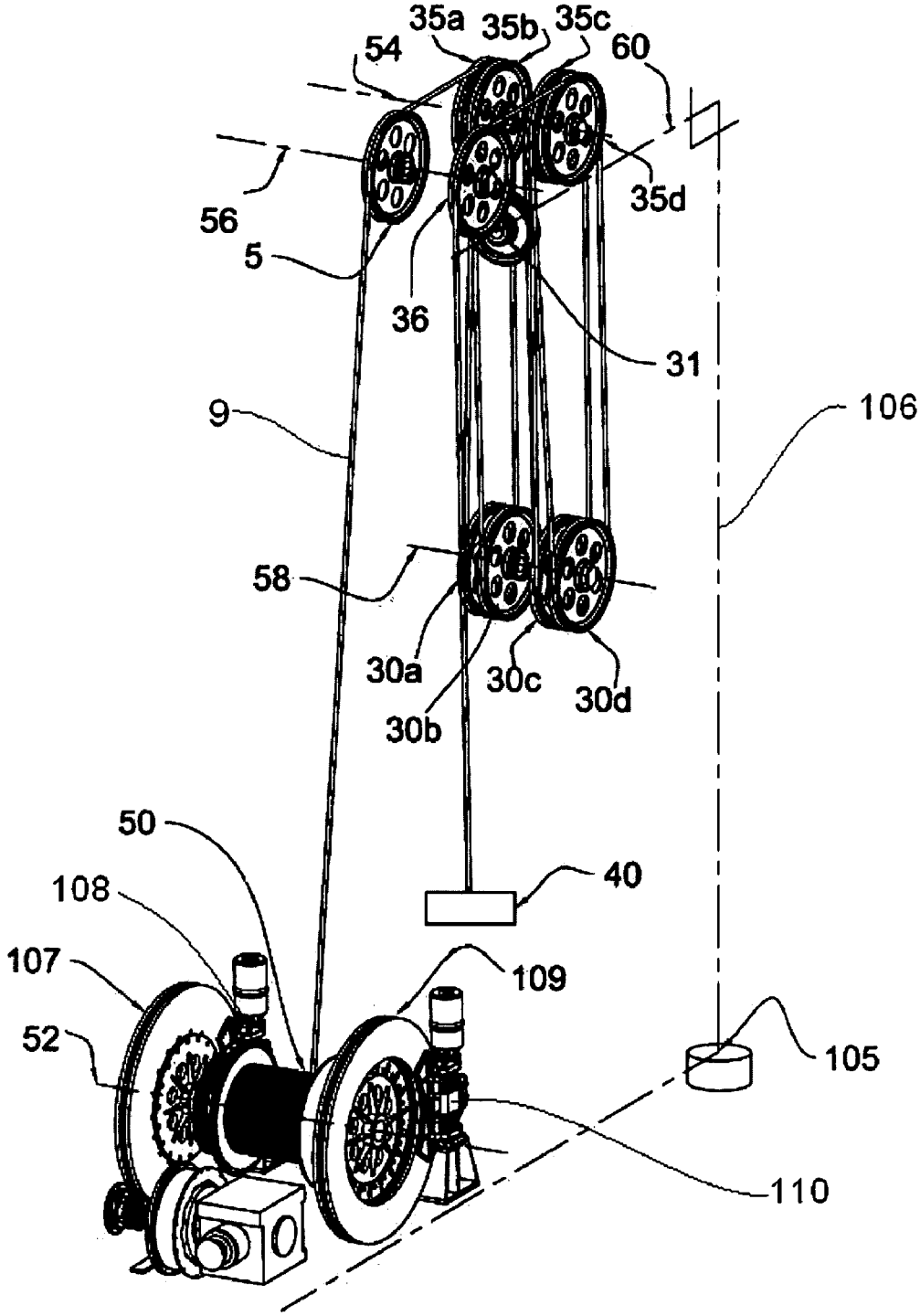
FIG. 2 depicts a perspective view of the crown and traveling swivel frame of the invention.

FIG. 2 depicts the drawworks assembly (7) attached to the substructure (3). The drawworks has a drive shaft (127) in the center of the drawworks drum (50). The drawworks assembly that is a drawworks drum with brake and disc assembly having a capacity of 500 Horsepower (hp). The drawworks assembly has an air clutch and a controller to operate the drawworks. The drawworks is fixed to the substructure.

Figure 5:
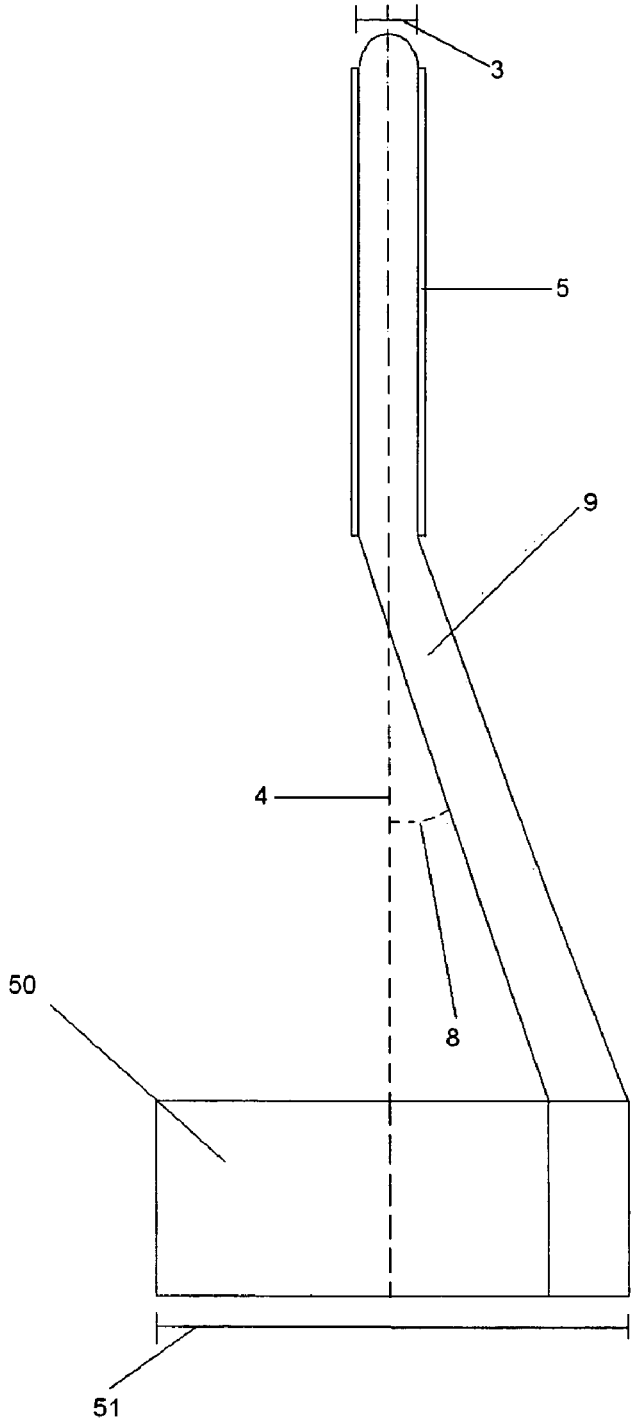
FIG. 5 depicts a view of the fast line sheave lined up with the drawworks drum.

The drawworks drum (50) has a width with a midpoint equal to one half of the width of the drum. AS depicted in FIG. 5, the midpoint of the drawworks drum assembly (7) is aligned with the midpoint of the fast line sheave, so that the maximum angle created by the drilling line and the fast line sheave are the same when the drilling line is at the edge of the drawworks drum.

The first traveling sheave (30*a*) of the traveling swivel frame assembly receives the drilling from the first front sheave (35*a*). A second front sheave (35*b*) is mounted to the crown block assembly for transferring the drilling line from the first traveling sheave (30*a*) to the second traveling sheave (30*b*).

For safety reasons, the cross over sheave preferably has a diameter of twenty times the drilling line diameter to accommodate many sizes of the traveling swivel frame assembly and to minimize drilling line stress. The diameter of all of the sheaves is at least twenty times larger than the diameter of the drilling line. In a preferred embodiment, the deadline sheave, the first front line sheave, the second front line sheave, the third front line sheave, and the forth front line sheave each have a diameter thirty times larger than the diameter of the drilling line.

Returning to FIG. 2, a first front sheave (35*a*) transfers the drilling line (9) from the fast line sheave (5) to the first traveling sheave (30*a*). The first traveling sheave (30*a*) transfers the drilling line (9) to the second front sheave (35*b*). The second front sheave (35*b*) transfers the drilling line (9) to the second traveling sheave (30*b*). The second traveling sheave (30*b*) transfers the drilling line (9) to the cross over sheave (31). The cross over sheave (31) receives the drilling line (9) from the second traveling sheave (30*b*). The third traveling frame sheave (30*c*) receives the drilling line (9) from the crown cross over sheave (31).

A third front sheave (35*c*) receives the drilling line (9) from the third traveling frame sheave (30*c*) and a fourth traveling frame sheave (30*d*) receives the drilling line (9) from the third front sheave (35*c*). The fourth front sheave (35*d*) receives the drilling line from the fourth traveling frame sheave (30*d*) and the deadline sheave (36) receives the drilling line from the fourth front sheave (35*d*) and transfers the line to a deadline anchor (40).

FIG. 2 shows the drawworks drum (50) is with a drum axis (52). The width of the drawworks drum is such that the drilling line and the fast line sheave do not create an angle of 15 degrees or more regardless of where the drilling line is on the drawworks drum. The front sheaves (35*a*, 35*b*, 35*c*, and 35*d*) are all aligned on a front axis (54). The fast line sheave and the deadline sheave are both aligned on a back axis (56). The traveling frame sheaves (30*a*, 30*b*, 30*c*, and 30*d*) are each mounted on the traveling frame with a traveling frame axis (58). The front axis, back axis, and traveling frame axis are parallel to the drum axis. The cross over sheave defines a cross over axis (60) and the cross over axis creates an angle with the drum axis (52) that is perpendicular or about 90 degrees.

In a preferred embodiment, the cross over axis (60) is parallel to the ground and is perpendicular to a well bore vertical axis (106) extending from the well bore (105).

Additionally, the drawworks assembly can comprise two air operated caliper brakes (108 and 110) for slowing or stopping the rotation on the drawworks drum. The air operated calipers are mounted to the drawworks assembly with an air cooled disc installed on the drawworks drum. The disks for the air operated caliper brakes are preferably a size of 60 inches in diameter. This size allows the brakes to cool themselves adequately with the surrounding air and does not require a secondary cooling system. An example of the brakes can be obtained from Kobelt, of Vancouver, Canada. In the preferred embodiment, the brakes can have air cooled discs (107 and 109). Air cooled breaks are much more cost effective than water cooled breaks that require associated piping to carry water to and from the breaks. The caliper system eliminates the need of a water cooled auxiliary braking system for lowering of the traveling assembly. A specifically sized main drum along with the placement of the drawworks eliminates any side load on the fast line sheave, thereby reducing the wear and stresses on the drilling line and the sheaves and reducing the loads on the drum and the sheave bearings.

The caliper brakes are operated with an air operating system. The caliper break reduces most of the force needed to operate a manual brake handle because the air operated valves only require minimum effort to operate the caliper brakes. The caliper brakes eliminate the need to adjust the brake bands or any linkages.

Figure 3:
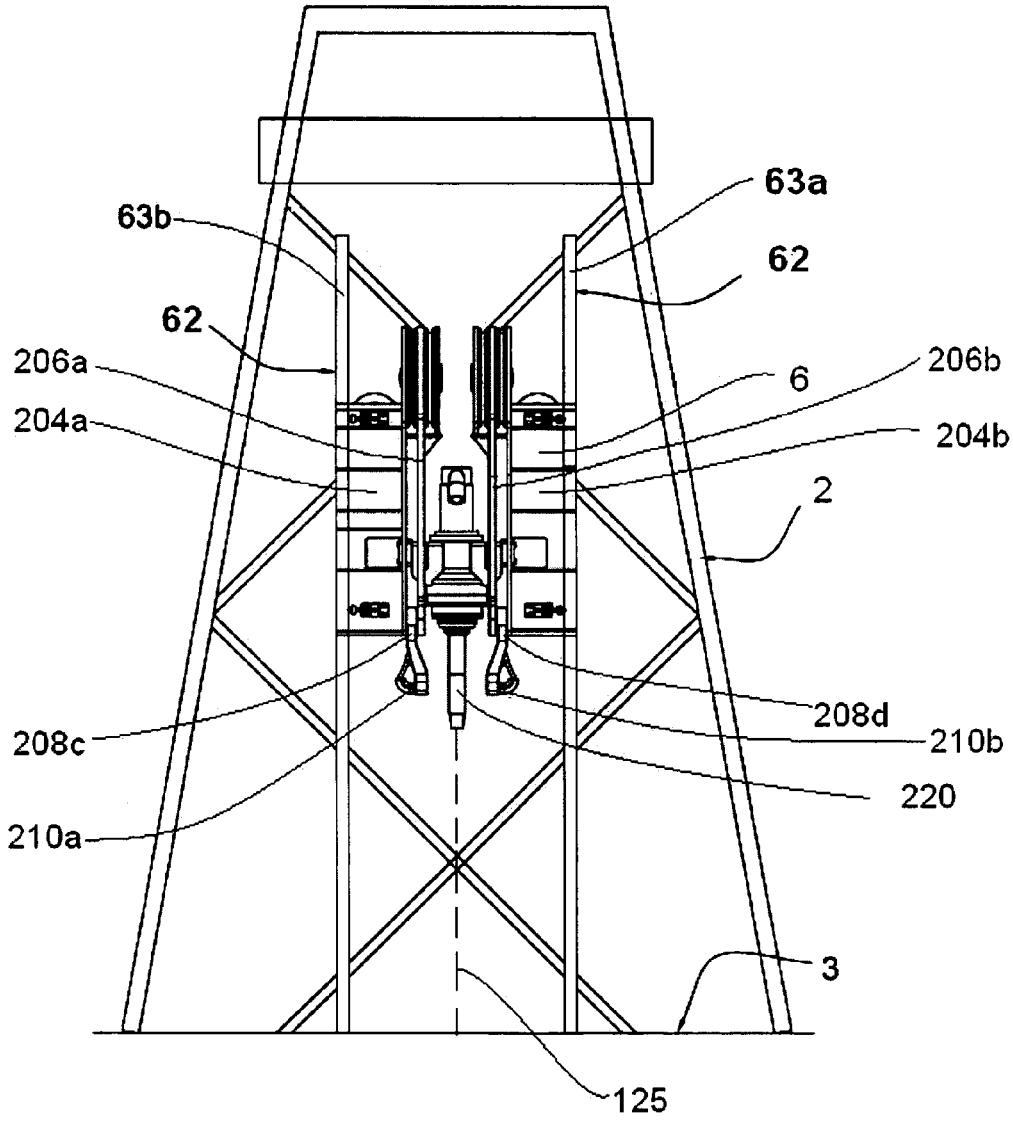
FIG. 3 depicts a cross sectional view of a mast with a support guide.

FIG. 3 depicts a mast (2) attached to the substructure (3) with a support guides (62) for guiding the vertical motion of the traveling swivel frame assembly (6). The support guides (62) can be attached to the substructure (3). Alternatively, the support guides (62) can be attached only to the mast (2) and not be in contact with the substructure (3).

In one embodiment, the support guides (62) are a pair of rails (63*a* and 63*b*) attached to the front side of a mast. In another embodiment, the rails do not engage the substructure and are only used for guiding the vertical movement of the traveling swivel frame assembly. The rails (63*a* and 63*b*) are preferably made of square or rectangular steel tubing. In supporting the traveling swivel frame assembly, the support guides provide a stabilizing force to support the torque applied to traveling swivel frame assembly by a top drive unit to allow the torque to be applied to the drilling pipe. Alternatively, the support guide (62) can comprise a single rail. A top drive unit (220) is shown in FIG. 3 attached to the traveling swivel frame assembly (6).

The top drive (220) is attached to the traveling swivel frame assembly at the first and the second load structures (206*a* and 206*b*). The top drive unit is made up of a power frame and the load structure. A first hook (210*a*) is attached to the first load structure and the second hook (210*b*) is attached to the second load structure. Elevator links are attached to the hooks. The elevator links are used to lift drill pipe, drill casing, drilling collars, and other drilling items from a horizontal position as they are stored into a vertical position for drilling. Pins (208*c* and 208*d*) are used to attach the hooks to the guide frame (204*a* and 204*b*). The addition of the hooks allows the traveling swivel frame assembly to be used as a hoisting block without the need for additional sets of hoisting blocks.

Continuing with FIG. 3, the mast (2) is depicted as a derrick and the traveling swivel frame assembly is mounted to a support guide (62). The traveling swivel frame assembly can move in a vertical direction along a vertical axis (125).

Fasteners are used to attach the power swivel to the first and the second load structures to form the top drive. The fasteners can be pins, such as 2½ inch to 3 inch diameter pins. In a preferred embodiment, one pin is used on each side of the top drive (220) to affix it to the load structure.

A first hook (210*a*) is attached to the first load structure and a second hook (210*b*) is attached to the second load structure. The hooks enable additional pipe or casing, or pipe elevator links to be secured to the traveling swivel frame assembly allowing the traveling frame to be used as a conventional set of hoisting blocks, thereby eliminating the need for an extra crane or other hoisting equipment with the drilling rig. This benefit reduces cost of repair and enables a smaller sized rig to drill with the loads of larger rigs.

The hooks can be the type known as "cobra hooks" that are available from Venture Tech of Houston, Tex. Ultra sturdy and strong snap shackles with extended metal shafts are usable herein, wherein the shaft accommodates a second set of pins (208*c* and 208*d*) to engage the traveling swivel frame assembly. Snap shackles can be custom made with a shaft about 1–2 feet long and a snap shackle diameter of about 10 inches. The snap shackle preferably opens and closes with an upper and a lower bolt. The hooks can be used to pickup drill pipe, drill collars, fishing tools, drill casing, and other drill rig parts.

Figure 4:
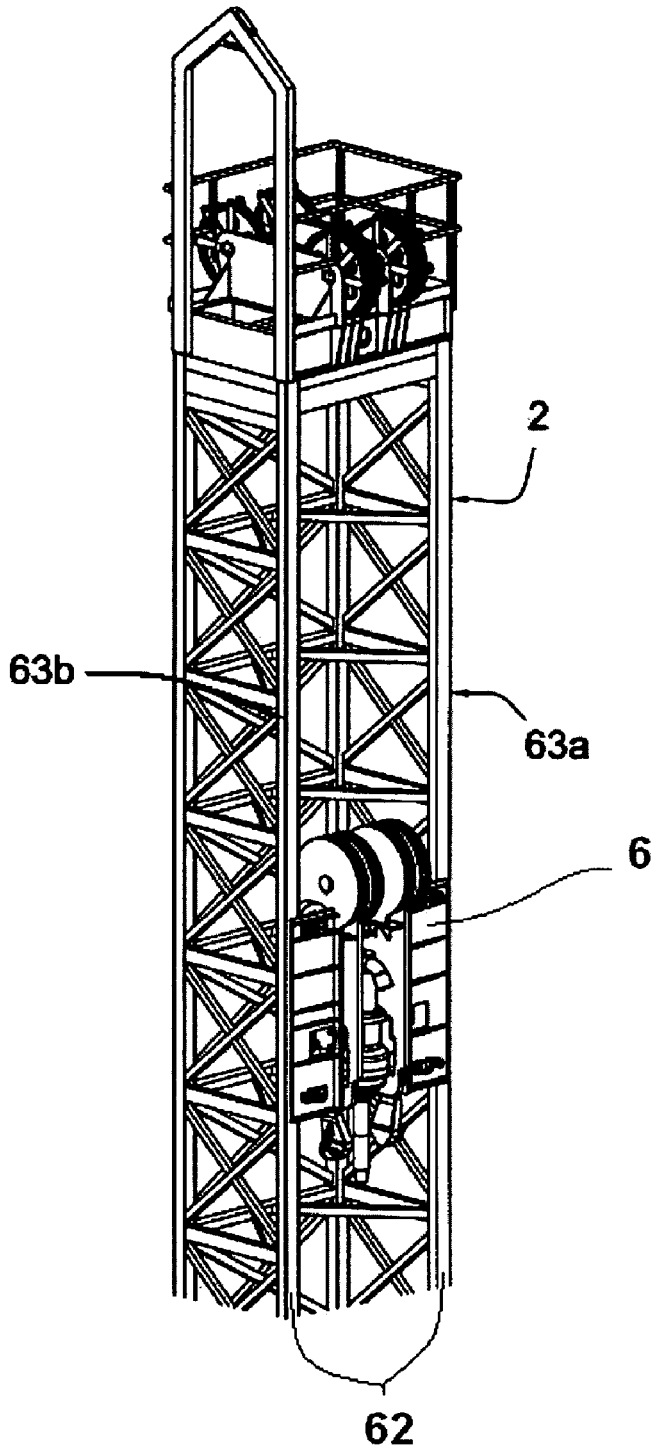
FIG. 4 depicts a cross sectional detailed view of the swivel traveling support.

FIG. 4 depicts an alternative mast (2) to the mast depicted in FIG. 3. The mast (2) can have a support guide (62) for guiding the vertical motion of the traveling swivel frame assembly (6). In a preferred embodiment, the support guide (62) is a pair of rails (63*a* and 63*b*) attached to the front side of a mast. The rails are only used for guiding the vertical movement of the traveling swivel frame assembly. The rails are preferably made of square or rectangular steel tubing.

FIG. 5 depicts the midpoint (4) of the fast line width (3) of the fast line sheave (5) and the midpoint (4) of the drum width (51) of the drawworks drum (50). FIG. 5 depicts the angle (8) created by the midpoint (4) of the fast line sheave (5) and the drilling line (9). The drum width (51) is selected so that a maximum of less than 15 degrees is created by the angle (8).

While these embodiments have been described with emphasis on the preferred embodiments, it should be understood that within the scope of the appended claims, the embodiments might be practiced other than as specifically described herein.

What is claimed is:

1. An earth drilling machine comprising:

a. a mast having a mast top and a mast bottom, wherein the mast bottom is mounted to a substructure;

b. a crown block assembly mounted on the mast top for engaging a drilling line wherein the crown block assembly comprising: a first front sheave, a second front sheave, a third front sheave, and a fourth front sheave wherein the first front sheave, the second front sheave, the third front sheave and the fourth front sheave are all aligned on a front axis;

c. a fast line sheave mounted to a crown block assembly for reeving the drilling line;

d. a traveling swivel frame assembly connected to the mast, wherein the traveling frame assembly comprises with a first traveling sheave, a second traveling sheave, a third traveling sheave, and a fourth traveling sheave, and wherein the first traveling sheave, the second traveling sheave, the third traveling sheave, and the fourth traveling sheave are aligned on a traveling frame axis; and further wherein the first traveling sheave receives the drilling line from the first front sheave;

e. wherein the traveling swivel frame assembly is vertically movable along a vertical axis, wherein the vertical axis extends from the mast top to the mast bottom; and wherein the first front sheave transfers the drilling line from the fast line sheave to the first traveling sheave;

f. a top drive removably mounted to the traveling swivel frame assembly for rotating the earth drilling equipment;

g. the second front sheave mounted to the crown block assembly transfers the drilling line from the first traveling sheave to the second traveling sheave;

h. a crown cross over sheave receives the drilling line from the second traveling sheave and transfers the drilling line to the third traveling sheave;

i. a third front sheave receives the drilling line from the third traveling sheave and transfers the drilling line to the fourth traveling sheave;

j. the fourth traveling sheave transfers the drilling line to the fourth front sheave;

k. a deadline sheave receives the drilling line from the fourth front sheave and transfers the drilling line to a deadline anchor; and wherein the fast line sheave and the deadline sheave are both aligned on a back axis;

l. a drawworks assembly comprises a drawworks drum with a drum axis and wherein the front axis, the back axis, and the traveling frame axis are parallel to the drum axis; and m. wherein the crown cross over sheave defines a cross over axis and the cross over axis is mounted perpendicular to the drum axis.

2. The earth drilling machine of claim 1, wherein the cross over axis is perpendicular to and intersects a well bore axis of a well bore.

3. The earth drilling machine of claim 1, wherein the drawworks assembly comprises two air operated caliper brakes mounted to the draw works assembly, each with an air cooled disc installed on the drawworks drum.

4. The earth drilling machine of claim 3, wherein the caliper brake is pneumatically actuated.

5. The earth drilling machine of claim 3, wherein the caliper brake is cooled by ambient air.

6. The earth drilling machine of claim 5, wherein the caliper brake is a 60 inch diameter disc brake.

7. The earth drilling machine of claim 1, wherein the drilling line is wire rope with an outside diameter (OD) from 1 inch to 1 and ⅛ inches.

8. The earth drilling machine of claim 7, wherein the wire rope has an outside diameter of 1 inch.

9. The earth drilling machine of claim 1, further comprising a support guide attached to the substructure for guiding the vertically movable traveling swivel frame assembly.

10. The earth drilling machine of claim 9, wherein the support guide stabilizes the traveling swivel frame assembly to allow torque to be applied to the drill pipe.

11. The earth drilling machine of claim 9, wherein the support guide comprises at least two rail.

12. The earth drilling machine of claim 1, further comprising a support guide attached to the mast for guiding the vertically movable traveling swivel frame assembly.

13. The earth drilling machine of claim 12, wherein the support guide stabilizes the swivel frame assembly to allow torque to be applied to the drill pipe.

14. The earth drilling machine of claim 12, wherein the support guide comprises at least two of rails.

15. The earth drilling machine of claim 12, wherein the support guide is additionally attached to the substructure.

16. The earth drilling machine of claim 1, wherein a midpoint of a width of the drawworks drum is aligned with a midpoint of a width of the fast line sheave, and wherein the width of the drawworks drum is selected so that an angle created by the drilling line and the fast line sheave comprises less than 15 degrees.

17. The earth drilling machine of claim 1, wherein the crown cross over sheave has a diameter that is 20 times larger than a diameter of the drilling line, allowing the crown cross over sheave to accommodate a range of sizes of the traveling swivel frame assembly.

18. The earth drilling machine of claim 1, wherein the fast line sheave, the deadline sheave, the first front line sheave, the second front line sheave, the third front line sheave, and the forth front line sheave, each have a diameter of at least 20 times larger than the diameter of the drilling line.

19. The earth drilling machine of claim 1, wherein the fast line sheave, the deadline sheave, the first front line sheave, the second front line sheave, the third front line sheave, and the forth front line sheave, each have a diameter of at least 30 times larger than the diameter of the drilling line.

20. The earth drilling machine of claim 1, further comprising at least one hook attached to bottom of the traveling swivel frame assembly.

* * * * *